US006387604B2

(12) United States Patent
Sampei

(10) Patent No.: US 6,387,604 B2
(45) Date of Patent: May 14, 2002

(54) PROCESSING METHOD OF THERMALLY DEVELOPABLE PHOTOSENSITIVE MATERIAL

(75) Inventor: Takeshi Sampei, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/237,590

(22) Filed: Jan. 26, 1999

(30) Foreign Application Priority Data

Jan. 28, 1998 (JP) ..... 10-030563

(51) Int. Cl.[7] ..... G03C 1/498
(52) U.S. Cl. ..... 430/350; 430/264; 430/619
(58) Field of Search ..... 430/619, 264, 430/350

(56) References Cited

U.S. PATENT DOCUMENTS 5,962,182 A * 10/1999 Katoh et al. ..... 430/405

FOREIGN PATENT DOCUMENTS

| | | |
|---|---|---|
| EP | 0692391 | 1/1996 |
| EP | 0763425 | 3/1997 |
| EP | 0848286 | 6/1998 |
| EP | 0903622 | 3/1999 |
| WO | WO9711407 | 3/1997 |

* cited by examiner

*Primary Examiner*—Thorl Chea
(74) *Attorney, Agent, or Firm*—Bierman, Muserlian & Lucas

(57) ABSTRACT

A processing method which thermally develops a thermally developable photosensitive material which is exposed imagewise, comprising the step of thermally developing said thermally developable photosensitive material using heating element which intermittently heats and has duration time of surface temperature of not less than 250° C. to be not more than 1 second, wherein said thermally developable photosensitive material comprising a support having thereon one layer or plural layers; containing organic silver salt, photosensitive silver halide grains and a reducing agent.

10 Claims, 1 Drawing Sheet

PROCESSING METHOD OF THERMALLY DEVELOPABLE PHOTOSENSITIVE MATERIAL

FIELD OF THE INVENTION

The present invention relates to a processing method of a thermally developable photosensitive material which exhibits excellent size repetition accuracy and specifically, to a thermally developable printing plate-making photosensitive material which is suitable for color printing.

BACKGROUND OF THE INVENTION

Conventionally, in the printing and plate-making field, solution waste generated along with the wet process for image forming materials has caused problems regarding worakability, and in recent years, a decrease in the processing solution waste has been strongly demanded in terms of environmental protection and room saving.

Thus, a technique for light heat photographic material for a technical photographic use is demanded in which exposure can be sufficiently carried out using a laser image setter, and sharp and bright images with high resolving power can be achieved.

As such techniques, methods are well known which are described, for example, in U.S. Pat. Nos. 3,152,904 and 3,487,075 and D. Morgan, "Dry Silver Photographic Materials" (Handbook of Imaging Materials, Marcel Dekker, Inc. page 48, 1991), etc. These photosentive materials are developed at high temperature of not less than 80° C. and are referred to as thermally developable photosensitive materials.

When a printing plate-making photosensitve material is used for color printing, ordinarily, a plurality of films subjected to color separation for each color are employed. These are exposed to each of several printing plates and printing is carried out upon superimposing them. When a plurality of films subjected to color separation for each color are not superimposed in such a manner that each image is identically positioned, a phenomenon termed doubling is caused in resulting prints. Accordingly, in the printing plate-making photosensitive material, it is required that the sizes are identical throughout the development process, that is, the repetition accuracy is critical.

However, the conventional thermally developable photosensitive materials as described above, when developed at high temperatures, have exhibited insufficient size repetition accuracy described above and when employed for color printing, have not been commercially viable. Furthermore, when storing thermally developed samples, the resulting samples have not been commercially viable due to occasional staining and degraded silver tone.

SUMMARY OF THE INVENTION

Accordingly, in view of the foregoing, the present invention was accomplished. An object of the present invention is to provide a processing method of a thermally developable photosensitive material which exhibits excellent size repetition accuracy. Another object is to provide a processing method of a thermally developable photosensitive material which results in minimum staining and minimum degradation of silver tone during storage after thermal development processing, and in particular, to provide a processing method of a thermally developable printing plate-making photosensitive material especially suitable for color printing.

DETAILED DESCRIPTION OF THE INVENTION

Figure 1:
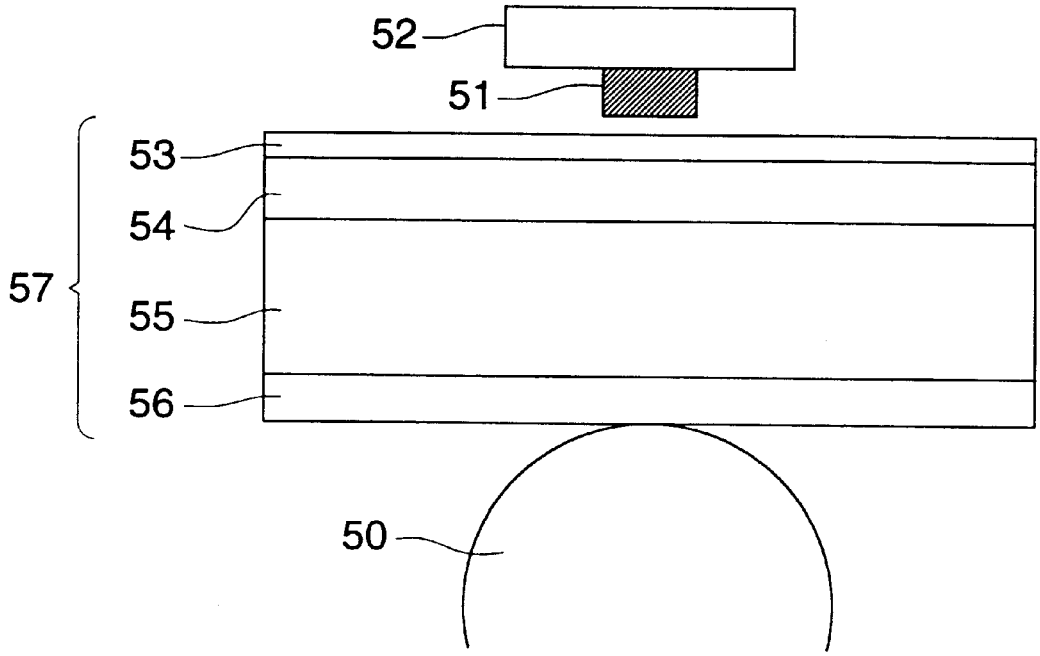
FIG. 1 is an outline of a cross sectional view of the heat element and the thermally developable photosensitive material used in the invention.

Above objects of the invention could be attained by the following methods.

1. A processing method which thermally develops a thermally developable photosensitive material which is exposed imagewise, comprising the step of thermally developing said thermally developable photosensitive material using heating element which intermittently heats and has duration time of surface temperature of not less than 250° C. to be not more than 1 second, wherein said thermally developable photosensitive material comprising a support having thereon one layer or plural layers; containing organic silver salt, photosensitive silver halide grains and a reducing agent.

2. A processing method of item 1, wherein said heating element is a thermal head.

3. A processing method of item 1, wherein one layer or plural layers of said thermally developable photosensitive material contain a hydrazine derivative.

4. A processing method of item 1, wherein one layer or plural layers of said thermally developable photosensitive material contain a quaternary onium compound.

5. A processing method of item 1, wherein said thermally developable photosensitive material comprising a support having thereon plural layers, wherein plural layers comprises an emulsion layer containing said photosensitive silver halide grains and a protective layer protecting said emulsion layer.

6. A processing method of item 1, wherein said thermally developable photosensitive material is thermally developed by contacting said thermally developable photosensitive material with said heating element.

7. A processing method of item 6, wherein said thermally developable photosensitive material is thermally developed by contacting a side of the layer containing said photosensitive silver halide grains of said thermally developable photosensitive material with said heating element.

8. A processing method of item 6, wherein smooster value of the surface of said thermally developable photosensitive material contacting with said heating element is not more than 50 mmHg.

9. A processing method of item 6, wherein hardness of the surface of said thermally developable photosensitive material contacting with said heating element is not less than 0.8 Gpa.

The embodiments of the present invention are detailed below.

As thermally developable photosensitive material to which the processing method of the present invention is applied, those can be employed which are disclosed, as described above, in, for example, U.S. Pat. Nos. 3,152,904 and 3,457,075, and D. Morgan, "Dry Silver Photographic Material" and D. Morgan and B. Shely, "Thermally Processed Silver Systems" (Imaging Processes and Materials) Neblette, 8th Edition, edited by Sturge, V. Walworth, and A. Shepp, page 2, 1969), etc.

The processing method of the present invention is characterized in that thermal development is carried out using a heating element with a surface temperature of not less than 250° C. Namely, after exposure, images are formed by thermal development utilizing a heating element with a surface temperature of at least 250° C. Heat sources of the heating elements usable for thermal development include thermal pens, thermal heads, thermal stamps, far-infrared radiation, etc. Of these, preferred are heating elements which can intermittently heat the surface to not less than 250° C. within at least 1 second. The preferred embodiment of such a heating element is a thermal head which is formed by arranging a plurality of heating elements, and the thermal head in which heating elements are equally spaced is preferably employed.

In the present invention, thermal development is carried out using Joule heat. The temperature of a thermal head is elevated utilizing the Joule heat generated by running an electric current through a heating resistor composed of $RuO_2$, $Ta_2N$, Ta—Si, Cr—Si—O, etc. The temperature is elevated at maximum from 250° C. to 500° C., preferably to 480° C., and the duration of the above-mentioned temperatures is not more than 1 second, and is preferably between 0.01 and 10 milliseconds. In the present invention, a plurality of thermal heads are preferably arranged. The thermal heads are more preferably arranged in a line with a width of the photosensitive material being processed. By contacting the thermally developable photosensitive material with the heat element used in the invention, an embodiment that both the thermally developable photosensitive material and the heat element move correlatively is preferable. It is also allowed, that only the thermally developable photosensitive material moves while stopping the heat element, that only the heat element moves while stopping the thermally developable photosensitive material, and that both the heat element and the thermally developable photosensitive material move by changing each moving speed. It is preferable for the heat element to heat the layer side containing the photosensitive silver halide grains of the thermally developable photosensitive material.

FIG. 1 is a view explaining the thermal development system (processing method) according to the present invention. In this system, between a platen roller 50 and a thermal head 52 provided with a heating resistor 51, fed is a thermally developable photosensitive material 57 composed of a protective layer 53, a photosensitive layer 54, a support 55, and a backing layer 56. Thereafter, an electric current is supplied to the heating resistor 51 of the thermal head 52. When Joule heat is generated from the heating resistor 51, the protective layer 53 and the photosensitive layer 54 of the thermally developable photosensitive layer 57 is thermally developed to form images. The thermal development system employing such as a thermal head also exhibits an advantage in a minimum increase in background staining.

In the present invention, specifically, when a thermally developable photosensitive material is employed for the output of a printing image setter with an oscillating wavelength of 600 to 800 nm, hydrazine derivatives are preferably incorporated into a photosensitive material.

As hydrazine derivatives employed in the present invention, preferred are those having the following general formula (H).

General formula (H)

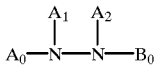

wherein $A_0$ represents an aliphatic group, an aromatic group, a $C_0$-$D_0$ group, or a heterocyclic group, each of which may have a substituent; $B_0$ represents a blocking group; both $A_1$ and $A_2$ represent hydrogen atoms, or one of which represents a hydrogen atom and the other represents an acyl group, a sulfonyl group or an oxalyl group. $C_0$ represents a —CO— group, a —COCO— group, a —CS— group, a —C(=$NG_1D_1$)— group, a —SO— group, a —$SO_2$— group or a —P(O)($G_1D_1$)— group; $G_1$ represents a simple linking groups such as a —O— group, —S— group, or —N($D_1$)— group; $D_1$ represents an aliphatic group, an aromatic group, a heterocyclic group, or a hydrogen atom; and $D_0$ represents a hydrogen atom, an aliphatic group, an aromatic group, a heterocyclic group, an amino group, an alkoxy group, an aryloxy group, an alkylthio group, or an arylthio group.

In general formula (H), aliphatic groups represented by $A_0$ preferably have from 1 to 30 carbon atoms, and straight, branched or cyclic alkyl groups having from 1 to 20 carbon atoms are particularly preferred and, for example, cited are a methyl group, an ethyl group, a t-butyl group, an octyl group, a cyclohexyl group, and a benzyl group. These may be substituted with a suitable substituent (for example, an aryl group, an alkoxy group, an aryloxy group, an alkylthio group, arylthio group, a sulfoxy group, a sulfonamido group, a sulfamoyl group, an acylamino group, a ureido group, etc.).

In the general formula (H), aromatic groups represented by $A_0$ are preferably mono ring condensed ring aryl groups, and cited, for example, are a benzene ring and a naphthalene ring. Heterocyclic groups represented by $A_0$ are preferably mono ring or condensed ring groups composed of a heterocycle containing at least one hetero atom selected from nitrogen, sulfur, and oxygen atoms, which are, for example, a pyrrolidone ring, an imidazole ring, a tetrahydrofuran ring, a morpholine ring, a pyridine ring, a pyrimidine ring, a quinoline ring, a thiazole ring, a benzothiazole ring, a thiophene ring, or a furan ring; as $A_0$, those particularly preferred are an aryl group, and aromatic groups and heterocyclic groups of $A_0$ may have a substituent and particularly preferred groups include a substituent having an acidic group with a pKa of 7 to 11, and specifically cited are a sulfonamido group, a hydroxyl group, a mercapto group, etc.

In the general formula (H), the —$G_0$—$D_0$— group represented by $A_0$ will now be described.

$G_0$ represents a —CO— group, a —COCO— group, a —CS— group, a —C(=$NG_1D_1$)— group, a —SO— group, a —$SO_2$— group, or a —P(O) ($G_1D_1$)— group, and as preferred $G_0$, listed are a —CO— group and a —COCO— group, and as particularly preferred, a —COCO— group is listed. $G_1$ represents a simple linking group, a —O— group, a —S— group or a —N($D_1$)— group, and $D_1$ represents an aliphatic group, an aromatic group, a heterocyclic group, or a hydrogen atom, and when a plurality of $D_1$s are present in a molecule, these may be the same or different.

$D_0$ represents a hydrogen atom, an aliphatic group, an aromatic group, a heterocyclic group, an amino group, an alkoxy group, an aryloxy group, an alkylthio group, an arylthio group, and as preferred $D_0$, listed are a hydrogen atom, an alkyl group, an alkoxy group, an amino group, an aryl group, etc.

Furthermore, in the general formula (H), $A_0$ preferably contains at least one of a nondiffusion group or a silver halide adsorption group. As the nondiffusion group, a ballast group is preferred which is commonly used as immobilizing photographic additives such as couplers, and the ballast groups include an alkyl group, an alkenyl group, an alkynyl group, an alkoxy group, a phenyl group, a phenoxy group, an alkylphenoxy group, etc. which have at least 8 carbon atoms and are photographically inactive.-

In the general formula (H), silver halide adsorption accelerators include thiourea, a thiourethane group, a mercapto group, a thioether group, a thione group, a heterocyclic groups, a thioamido heterocyclic group, a mercapto heterocyclic group, or adsorption groups described in Japanese Patent Publication Open to Public Inspection No. 64-90439.

In the general formula (H), $B_0$ represents a blocking group; preferably represents —$G_0$—$D_0$ which is the same as the —$G_0$—$D_0$ group in $A_0$, and $A_0$ and $B_0$ may be different.

Both $A_1$ and $A_2$ represent a hydrogen atom and when one of them represents a hydrogen atom, the other represents an acyl group (for example, an acetyl group, a trifluoroacetyl group, a benzoyl group, etc.), a sulfonyl group (for example, a methanesulfonyl group, a toluenesulfonyl group, etc.), or an oxalyl group (for example, an ethoxalyl group, etc.).

Specific examples represented by the general formula (H) are described below. However, the present invention is not limited to these examples.

H-1

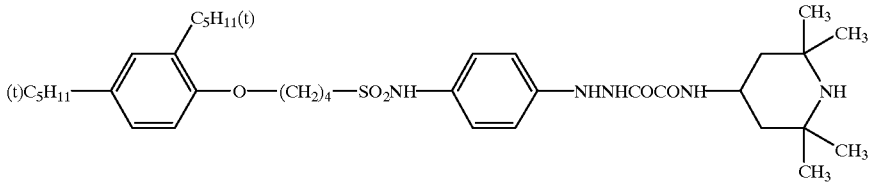

H-2

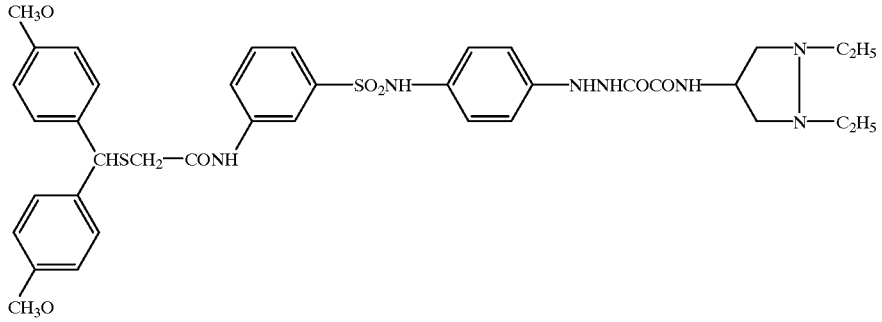

H-3

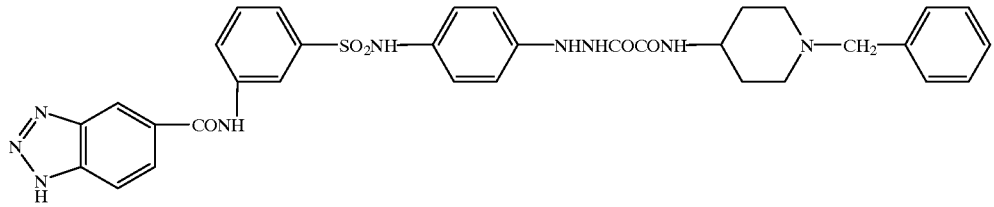

H-4

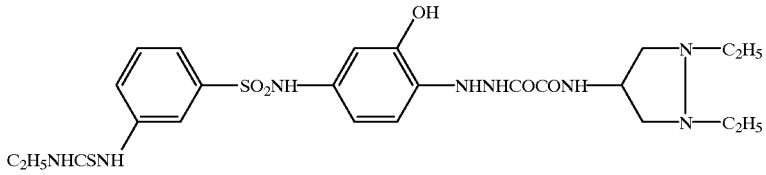

H-5

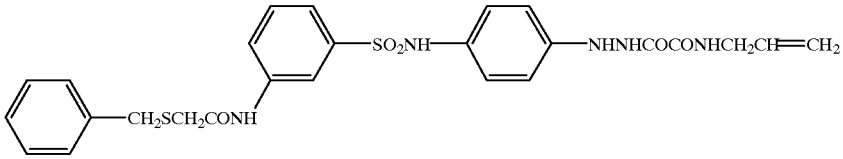

H-6

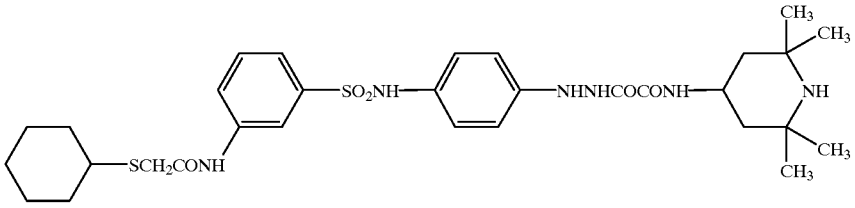

-continued
H-7
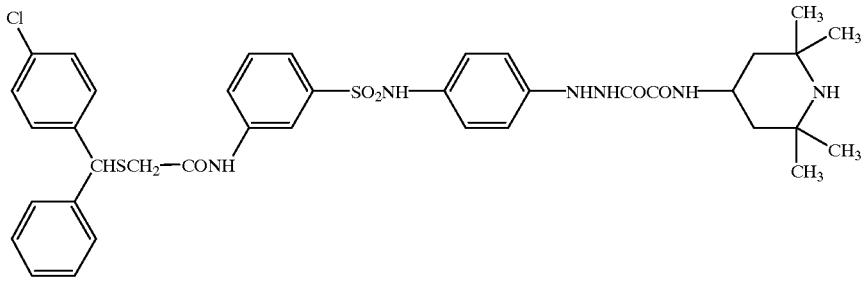
H-8
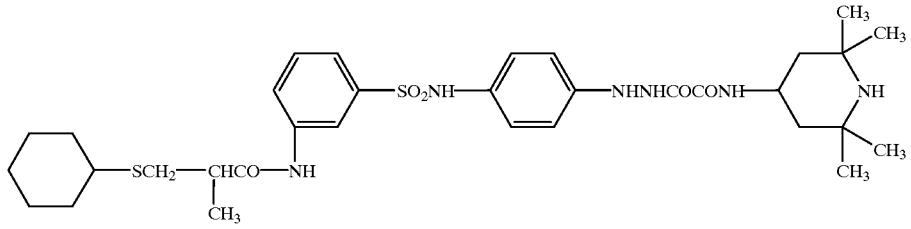
H-9
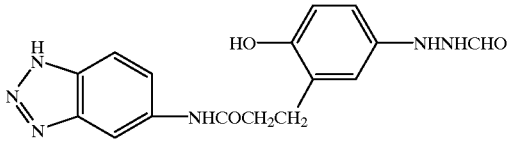
H-10
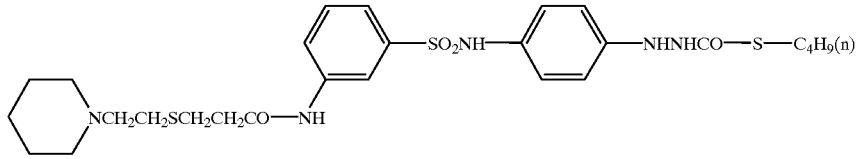
H-11
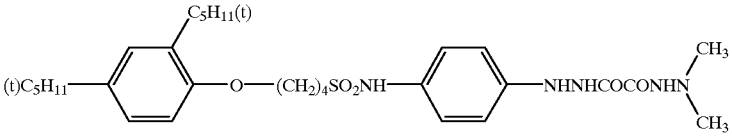
H-12
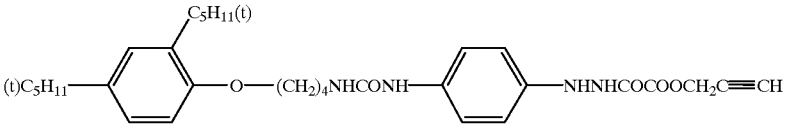
H-13
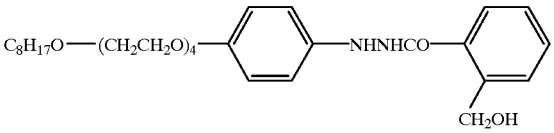
H-14
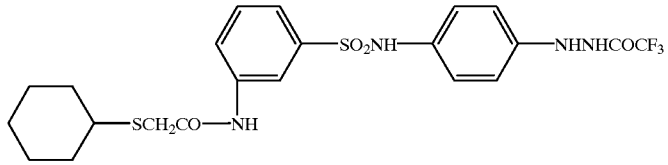

-continued
H-15
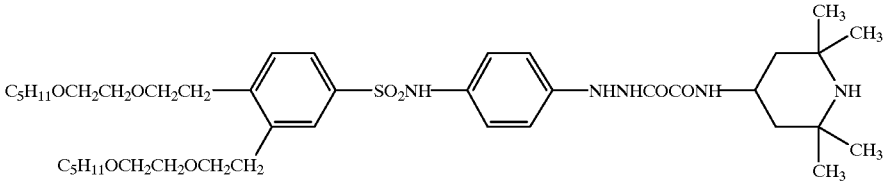
H-16
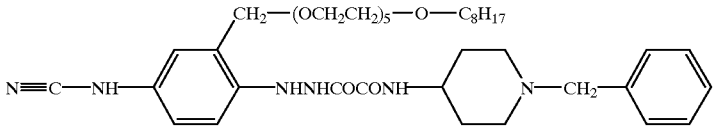
H-17
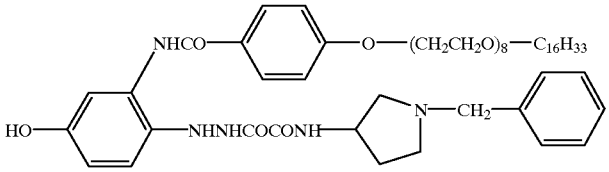
H-18
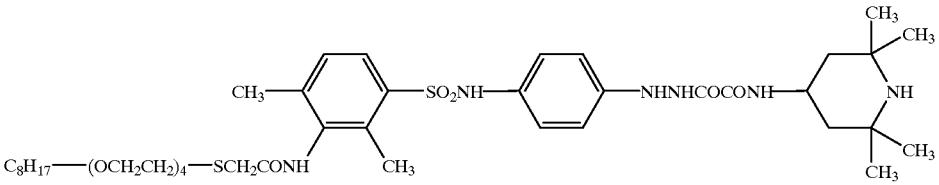
H-19
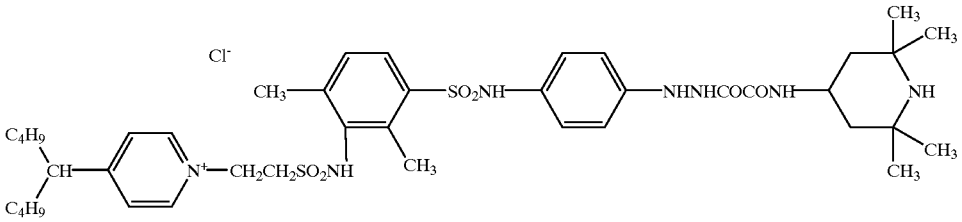
H-20
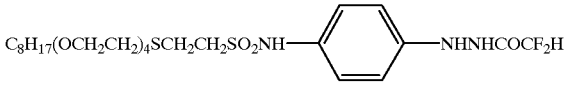
H-21
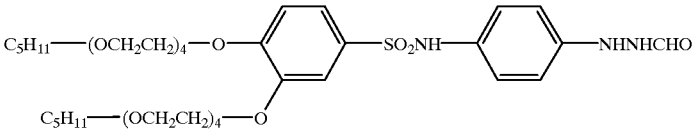
H-22
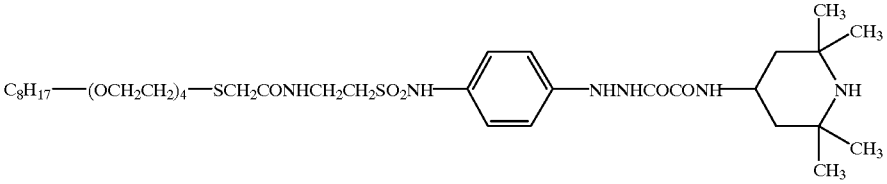

-continued
H-23
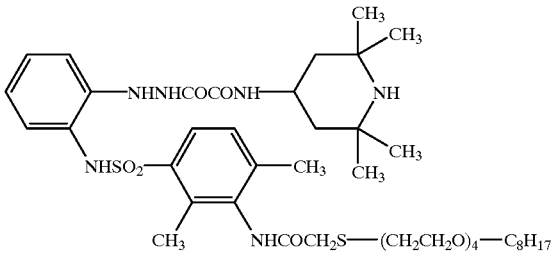
H-24
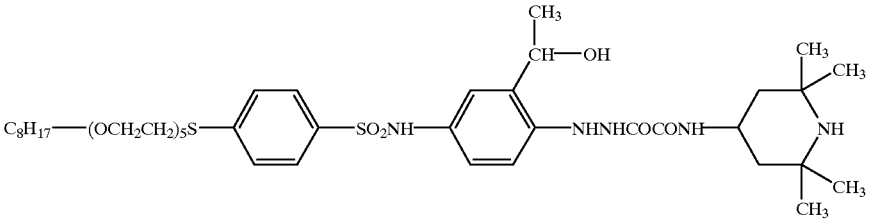
H-25
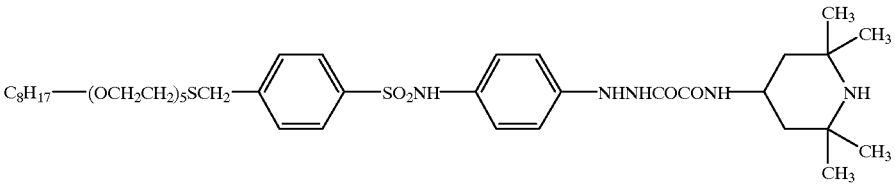
H-26
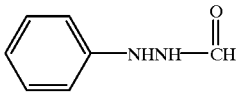
H-27
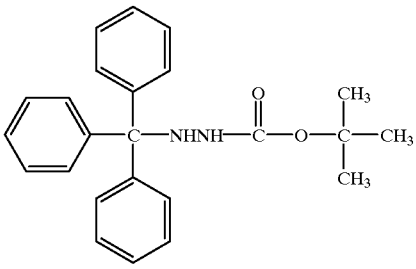
H-28
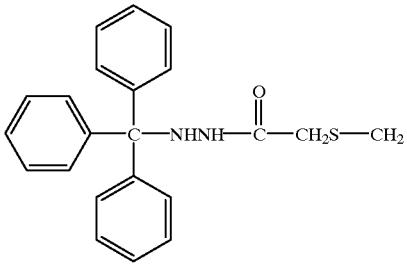
H-29
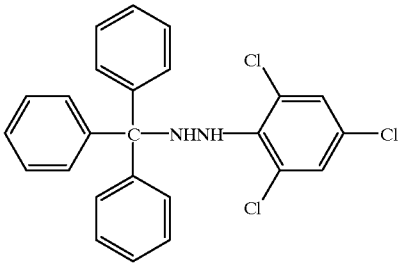
H-30
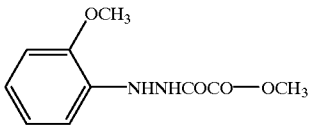
H-31
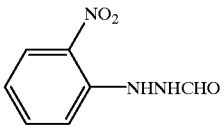
H-32
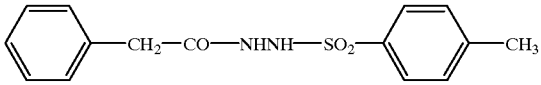
A hydrazine derivative addition layer is a photosensitive layer and/or a constitution layer adjacent to the photosensitive layer. The added amount is preferably in the range of $10^{-6}$ to $10^{-1}$ mole per mole of silver halide and is most preferably in the range of $10^{-5}$ to $10^{-2}$ mole, though the optimum amount is not defined, depending on the silver halide grain size, halide composition, chemical sensitization degree, reducing agent type, retarder type, etc.

As hydrazine compounds employed in the present invention, other than the compounds described above, those described below may also be employed.

In addition to the compounds described in Research Disclosure, Item 23516 (November 1983 Issue, page 345) and publications cited therein, listed can be those described in U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, and 5,104,769; U.K. Patent No. 2,011,391B; European Patent Nos. 217310, 301,799, and 356,898; and Japanese Patent Publication Open to Public Inspection Nos. 60-179734, 61-170733, 61-270744, 62-178246, 62-270948, 63-29751, 63-32538, 63-104047, 63-121838, 63-129337, 63-223744, 63-234244, 63-234245, 63-234246, 63-294552, 63-306438, 64-10233, 1-90439, 1-100530, 1-105941, 1-105943, 1-276128, 1-280747, 1-283548, 1-283549, 1-285940, 2-2541, 2-77057, 2-139538, 2-196234, 2-196235, 2-198440, 2-198441, 2-198442, 2-220042, 2-221953, 2-221954, 2-285342, 2-285343, 2-289843, 2-302750, 2-304550, 3-37642, 3-54549, 3-125134, 3-184039, 3-240036, 3-240037, 3-259240, 3-280038, 3-282536, 4-51143, 4-56842, 4-84134, 2-230233, 4-96053, 4-216544, 5-45761, 5-45762, 5-45763, 5-45764, 5-45765, 6-289524, and 9-160164, etc.

Furthermore, other than those, employed can be compounds described in (Ka 1) of Japanese Patent Publication No. 6-77138, specifically, compounds described on pages 3 and 4 of the Publication; compounds represented by general formula (I) in Japanese Patent Publication No. 6-93082, specifically, compounds 1 through 38 described on pages 8 to 18 of the Publication; compounds represented by general formula (4), general formula (5), and general formula (6) in Japanese Patent Publication Open to Public Inspection No. 6-230497, specifically, compounds 4-1 through 4-10 on pages 25 and 26, compounds 5-1 through 5-42 on pages 28 to 36, and compounds 6-1 through 6-7 on pages 39 and 40 of the Publication; compounds represented by general formula (I) and general formula (2) in Japanese Patent Publication Open to Public Inspection No. 6-289520, specifically, compounds 1-1) through 1-17) and 2-1) on pages 5 to 7 of the Publication; compounds described in (Ka 2) and (Ka 3) of Japanese Patent Publication Open to Public Inspection No. 6-313936, specifically, compounds described on pages 6 to 19 of the Publication; compounds described in (Ka 1) of Japanese Patent Publication Open to Public Inspection No. 6-313951, specifically, compounds described on pages 3 to 5 of the Publication; compounds represented by general formula (I) in Japanese Patent Publication Open to Public Inspection No. 7-5610, specifically, compounds I-1 through I-38 described on pages 5 to 10 of the Publication; compounds represented by general formula (II) in Japanese Patent Publication Open to Public Inspection No. 7-77783, specifically, compounds II-1 through II-102 described on pages 10 to 27 of the Publication; and compounds represented by general formula (H) and general formula (Ha) in Japanese Patent Publication Open to Public Inspection No. 7-104426, specifically, compounds H-1 through H-44 described on pages 8 to 15 of the Publication.

The quaternary onium compounds employed in the present invention are those having a nitrogen or phosphorous atom quaternary cationic group in the molecule and are preferably those represented by general formula (P) below.

General formula (P)

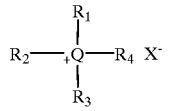

wherein Q represents a nitrogen atom or a phosphorous atom; $R_1$, $R_2$, $R_3$, and $R_4$ each represents a hydrogen atom or a substituent, and $X^-$ represent an anion. Furthermore, $R_1$ to $R_4$ may link with each other to complete a ring.

Substituents represented by $R_1$ to $R_4$ include an alkyl group (for example, a methyl group, an ethyl group, a propyl group, a butyl group, a hexyl group, a cyclohexyl group, etc.), an alkenyl group, (for example, an allyl group, a butenyl group, etc.), an alkynyl group (for example, a propargyl group, a butynyl group, etc.), an aryl group (for example, a phenyl group, a naphthyl group, etc.), a heterocyclic group (for example, a piperidinyl group, a piperadinyl group, a morpholinyl group, a piridyl group, a furyl group, a thienyl group, a tetrahydrofuryl group, a tetrahydrothienyl group, a sulforanyl group, etc.), and an amino group etc.

Rings which can be completed by linking $R_1$, $R_2$, $R_3$, and $R_4$ with each other include a piperidine ring, a morpholine ring, a piperazine ring, a quinuclidine ring, a pyridyl ring, a pyrrole ring, an imidazole ring, a triazole ring, a tetrazole ring, etc.

Groups represented by $R_1$ to $R_4$ may have substituents such as a hydroxyl group, an alkoxy group, an aryloxy group, a carboxyl group, a sulfo group, an alkyl group, an aryl group, etc.

As $R_1$, $R_2$, $R_3$, and $R_4$, a hydrogen atom and an alkyl group are preferred.

Anions represented by $X^-$ include inorganic or organic anions such as a halogen ion, a sulfate ion, a nitrate ion, an acetate ion, a p-toluenesufonate ion, etc.

More preferred compounds are those represented by the following general formulas (Pa), (Pb), or (Pc) and the following general formula (T).

General formula (Pa)

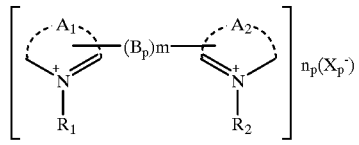

General formula (Pb)

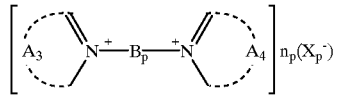

General formula (Pc)

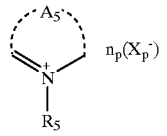

wherein $A_1$, $A_2$, $A_3$, $A_4$, and $A_5$ each represents a metal-free atom group to complete a nitrogen-containing heterocyclic ring; may contain an oxygen atom, a nitrogen atom, or a sulfur atom; and may be condensed with a benzene ring. Heterocyclic rings completed by $A_1$, $A_2$, $A_3$, $A_4$, and $A_5$ may have substituents which may be the same or different. Substituents include an alkyl group, an aryl group, an aralkyl group, an alkenyl group, an alkynyl group, a halogen atom, an acyl group, an alkoxycarbonyl group, an aryloxycarbonyl group, a sulfo group, a carboxy group, a hydroxyl group, an alkoxy group, an aryloxy group, an amide group, a sulfamoyl group, a carbamoyl group, a ureido group, an amino group, a sulfonamide group, a sulfonyl group, a cyano group, a nitro group, a mercapto group, an alkylthio group, and an arylthio group.

Cited as preferred examples of $A_1$, $A_2$, $A_3$, $A_4$, and $A_5$, can be 5- and 6-membered rings (each of pyridine, imidazole, thiazole, oxazole, pyrazine, pyrimidine rings, etc. and cited as a more preferred example, is a pyridine ring.

$B_p$ represents a divalent linking group and m represents 0 or 1. As divalent linking groups, cited can be an alkylene group, an arylene group, an alkenylene group, —$SO_2$—, —SO—, —O—, —CO—, —N($R_6$)— ($R_6$ represents an alkyl group, an aryl group or a hydrogen atom), or those formed in combinations thereof.

$R_1$, $R_2$ and $R_5$ each represents an alkyl group having from 1 to 20 carbon atoms and $R_1$ and $R_2$ may be the same or different. Alkyl groups as described herein represent substituted or unsubstituted alkyl groups. The substituents are the same as those listed for $A_1$, $A_2$, $A_3$, $A_4$, and $A_5$.

The preferred example of each of $R_1$, $R_2$, and $R_5$ is an alkyl group having from 4 to 10 carbon atoms. The more preferred example includes a substituted or unsubstituted aryl-substituted alkyl group.

$X_p^-$ represents a counter ion necessary for balancing the total charge of a molecule, for example, a chlorine ion, a bromine ion, an iodine ion, a nitrate ion, a sulfate ion, p-toluenesulfonate, oxalate, etc. $n_p$ represents the number of counter ions necessary for balancing the total charge of a molecule, and in the case of an internal salt, $n_p$ is 0.

General formula (T)

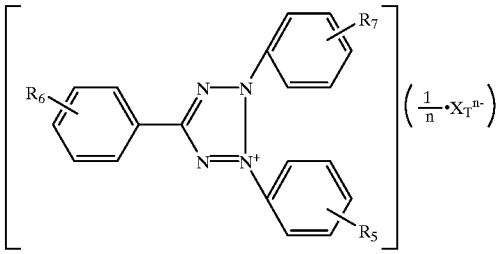

Substituents $R_5$, $R_6$, and $R_7$ of the phenyl group of triphenyltetrazolium compounds represented by the above-mentioned general formula (T) preferably represent hydrogen atoms or those having a negative Hammett sigma value (σP), indicating electron attracting capability.

The Hammett sigma values in phenyl groups can be found in many publications such as, for example, C. Hansch report cited in Journal of Medical Chemistry, Volume 20, page 304, 1977, etc. Groups having preferred negative sigma values include, for example, a methyl group (σP=−0.17, hereinafter, each value in parentheses shows a σP value), an ethyl group (−0.15), a cyclopropyl group (−0.21), a n-propyl group (−0.13), an iso-propyl group (−0.15), a cyclobutyl group (−0.15), a n-butyl group (−0.16), an iso-butyl group (−0.20), a n-pentyl group (−0.15), a cyclohexyl group (−0.22), an amino group (−0.66), an acetylamino group (−0.15), a hydroxyl group (−0.37), a methoxy group (−0.27), an ethoxy group (−0.24), a propoxy group (−0.25), a butoxy group (−0.32), a pentoxy group (−0.34), etc., all of which are useful as substituents of the compounds represented by general formula (T).

n represents 1 or 2. Anions represented by $X_T^{n-}$ include, for example, halide ions such as a chloride ion, a bromide ion, an iodide ion, etc.; inorganic acid radicals such as nitric acid, sulfuric acid, perchloric acid, etc.; organic acid radicals such as sulfonic acid, carboxylic acid, etc.; anionic surface active agents, specifically lower alkylbenzene sulfonic acid anions such as a p-toluenesulfonic acid anion, etc., higher alkylbenzenesulfonic acid anions such as a p-dodecylbenzenesulfonic acid anion, etc., higher alkylsulfate ester anions such as a laurylsulfate anion, etc., boric acid series anions such as tetraphenylboron, etc., dialkylsulfosuccinate anions such as a di-2-ethylhexylsulfosuccinate anion, etc., higher fatty acid anions such as a cetylpolyethenoxysulfate anion, etc., polymers of polyacrylic acid anion attached with an acid radical, etc.

Specific examples of quaternary onium compounds are described below. However, the present invention is not limited to these examples.

P-1

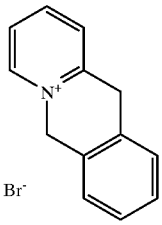

P-2

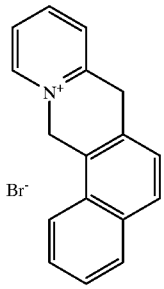

-continued
P-3
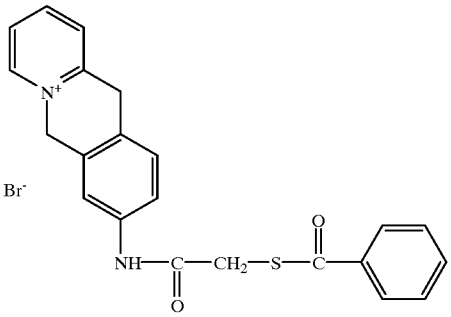
P-4
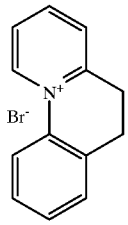
P-5
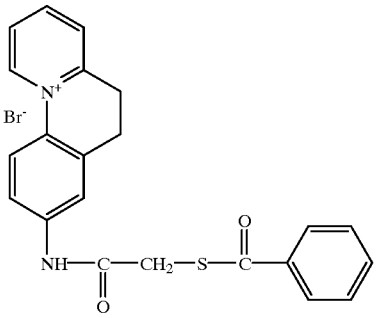
P-6
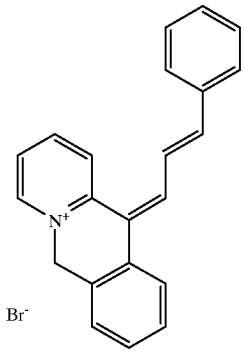
P-7
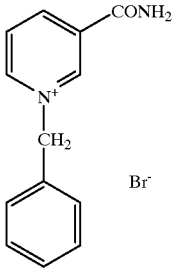
P-8
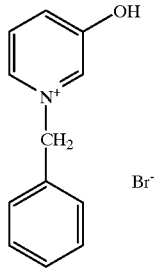
P-9
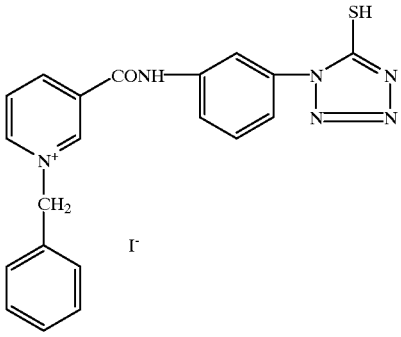
P-10
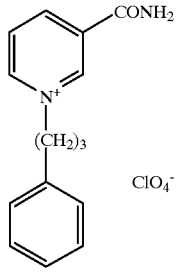
P-11
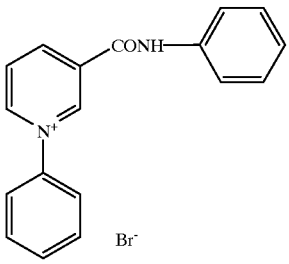
P-12
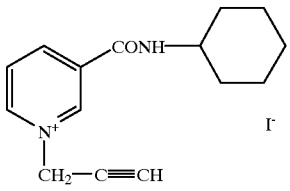

-continued
P-13
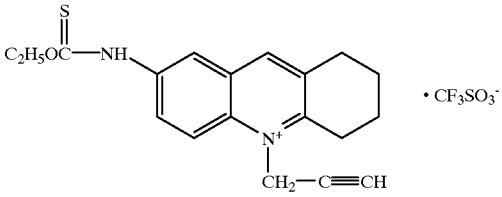
P-14
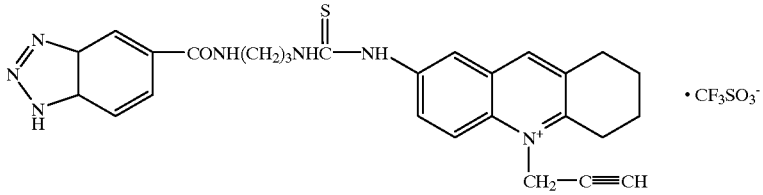
P-15
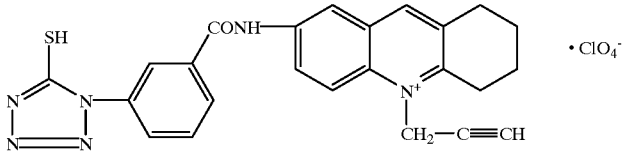
P-16
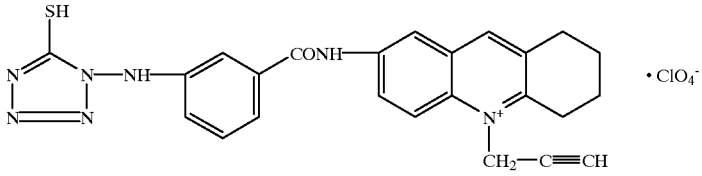
P-17
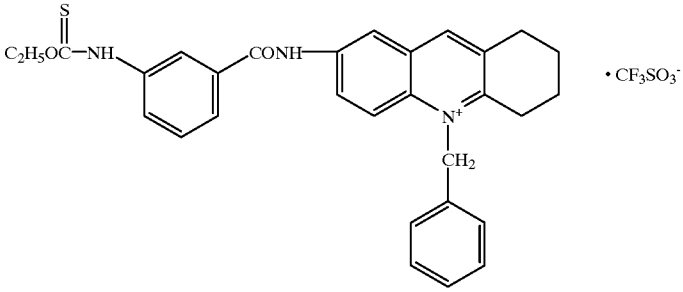
P-18
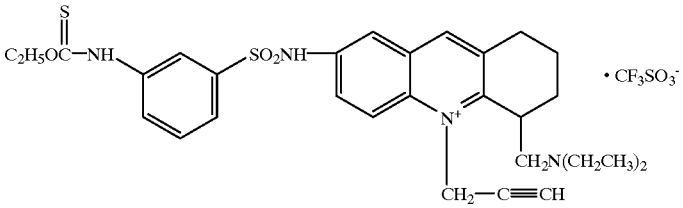
P-19
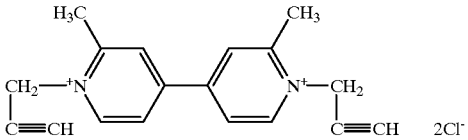

-continued
P-20
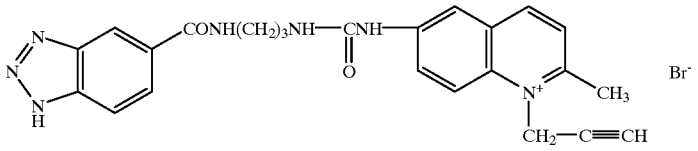
P-21
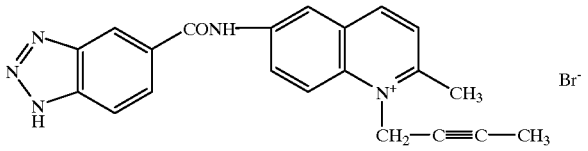
P-22
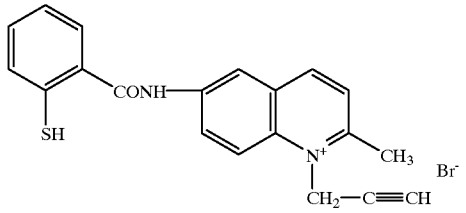
P-23
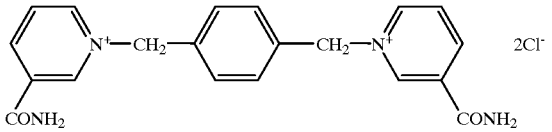
P-24
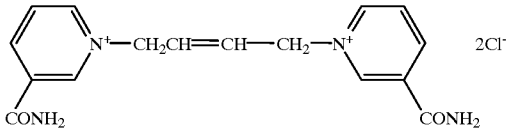
P-25
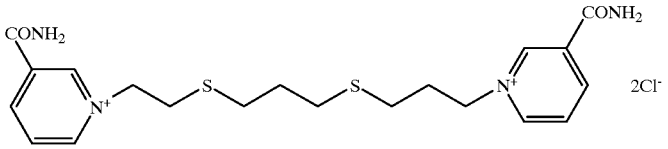
P-26
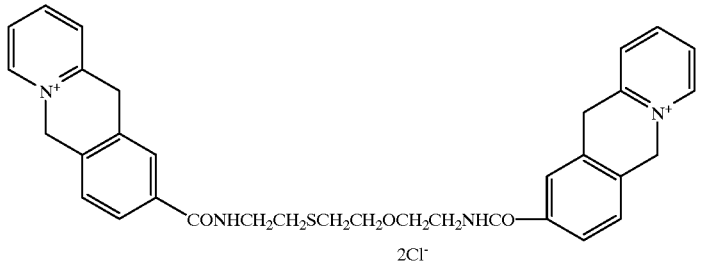
P-27
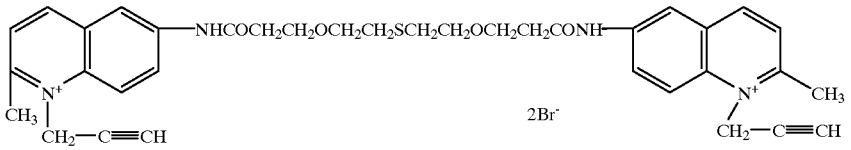

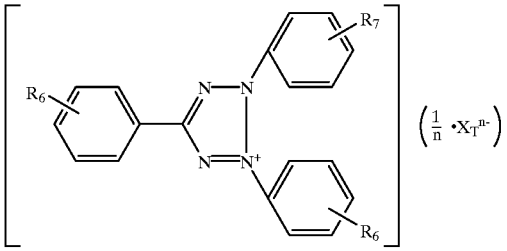

| Compound No. | $R_1$ | $R_2$ | $R_3$ | $X_T^{n-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl_-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_5H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

The above-mentioned quaternary onium compounds can readily be synthesized employing the known method. For example, the above-mentioned tetrazolium compounds can be synthesized referring to a method described in Chemical Reviews 55, pages 335 to 483.

The added amount of the quaternary compound is preferably between $1\times10^{-8}$ and about 1 mole per mole of silver halide, and is more preferably between $1\times10^{-7}$ and $1\times10^{-1}$ mole.

These can be added to a photosensitive material at any arbitrary time, from the silver halide grain formation to the actual coating.

The quaternary onium compounds may be employed individually or in combination of two or more, and may be added to any layer of the photosensitive material composition layers. However, these are preferably added to at least one composition layer on the side having the photosensitive layer and are more preferably added to a photosensitive layer and/or an adjacent layer thereof.

The thermally developable photosensitive material, to which the processing method of the present invention, is applied is one comprised of an organic silver salt, photosensitive silver halide grains and a reducing agent. Of these, silver halide grains function as a light sensor. In the present invention, in order to minimize the translucence after image formation and to obtain excellent image quality, the average grain size is preferably minute. The average grain size is preferably not more than 0.1 $\mu$m; is more preferably between 0.01 and 0.1 $\mu$m, and is most preferably between 0.02 and 0.08 $\mu$m. The average grain size as described herein implies the ridge line length of a silver halide grain when it is a so-called regular crystal which is either cubic or octahedral. When the grain is not a regular crystal, for example, when it is a spherical, cylindrical, or tabular grain, the grain size is the diameter of a sphere having the same volume as each of those grains.

Furthermore, silver halide is preferably monodispersed. The monodisperse as described herein means that the degree of monodispersibility obtained by the formula described below is not more than 40 percent. The more preferred grains are those which exhibit the degree of monodispersibility is not more than 30 percent, and the particularly preferred grains are those which exhibit a degree of monodispersibility is between 0.1 and 20 percent.

Degree of monodispersibility=(standard deviation of grain diameter)/(average of grain diameter)×100

In the present invention, the average grain diameter is preferably not more than 0.1 $\mu$m, and grains are preferably monodispersed. When grains are formed in this range, the graininess of images is also improved.

There is no particular limitation on the silver halide grain shape. However, a high ratio occupying a Miller index [100] plane is preferred. This ratio is preferably at least 50 percent; is more preferably at least 70 percent, and is most preferably at least 80 percent. The ratio occupying the Miller index [100] plane can be obtained based on T. Tani, J. Imaging Sci., 29, 165 (1985) in which adsorption dependency of a [111] plane and a [100] plane is utilized.

Furthermore, another preferred silver halide shape is a tabular grain. The tabular grain as described herein is a grain having an aspect ratio represented by r/h of not less than 3, wherein r represents a grain diameter in $\mu$m obtained as the square root of the projection area, and h represents thickness in $\mu$m in the vertical direction. Of these, the aspect ratio is preferably between 3 and 50. The grain diameter is preferably not more than 0.1 $\mu$m, and is more preferably between 0.01 and 0.08 $\mu$m. These are described in U.S. Pat. Nos. 5,264,337, 5,314,789, 5,320,958, and others, by which desired tabular grains can readily be prepared. When these tabular grains are used, image sharpness is further improved.

The composition of silver halide is not particularly limited and may be any of silver chloride, silver chlorobromide, silver chloroiodobromide, silver bromide, silver iodobromide, or silver iodide. The photographic emulsion employed in the present invention can be prepared employing methods described in P. Glafkides, "Chimie et Physique Photographique" (published by Paul Montel, 1967), G. F. Duffin, "Photographic Emulsion Chemistry" (published by The Focal Press, 1966), V. L. Zelikman et al., "Making and Coating Photographic Emulsion" (published by The Focal Press, 1964), etc.

Namely, any of several acid emulsions, neutral emulsions, ammonia emulsions, and the like may be employed. Furthermore, when grains are prepared by allowing soluble silver salts to react with soluble halide salts, a single-jet method, a double-jet method, or combinations thereof may be employed.

The resulting silver halide may be incorporated into an image forming layer utilizing any practical method, and at such time, silver halide is placed adjacent to a reducible silver source.

Furthermore, silver halide may be prepared by converting a part or all of the silver in an organic silver salt formed through the reaction of an organic silver salt with halogen ions into silver halide. Silver halide may be previously prepared and the resulting silver halide may be added to a solution to prepare the organic silver salt, or combinations thereof may be used, however the latter is preferred.

Generally, the content of silver halide in organic silver salt is preferably between 0.75 and 30 weight percent.

Silver halide employed in the present invention is preferably comprised of ions of metals or complexes thereof, in transition metal belonging to Groups VIB, VIIB, VIII and IB of the Periodic Table. As the above-mentioned metals, preferred are Cr and W (in Group VI); Re (in Group VIIB);

Fe, Co, Ni, Ru, Rh, Pd, Os, Ir, and Pt (in group VIII); and Cu and Au (in Group IB). Of these, when employed for printing plate-making photosensitive materials, it is preferred to use Rh, Re, Ru, Ir, or Os.

These metals may be incorporated into silver halide in the form of complexes. In the present invention, regarding the transition metal complexes, six-coordinate complexes represented by the general formula described below are preferred.

General formula $(ML_6)$ :$^m$ wherein M represents a transition metal selected from elements in Groups VIB, VIIB, VIII, and IB of the Periodic Table; L represents a coordinating ligand; and m represents 0, −1, −2, or −3.

Specific examples represented by L include halides (fluorides, chlorides, bromides, and iodides), cyanides, cyanates, thiocyanates, selenocyanates, tellurocyanates, each ligand of azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred specific example of M is rhodium (Rh), ruthenium (Ru), rhenium (Re) or osmium (Os).

Specific examples of transition metal ligand complexes are described below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[Ru(NO)Cl_5]^{2-}$
8: $[RuBr_4(H_2O)]^{2-}$
9: $[Ru(NO)\ (H_2O)Cl_4]^-$
10: $[RhCl_5(H_2O)]^{2-}$
11: $[Re(NO)Cl_5]^{2-}$
12: $[Re(NO)CN_5]^{2-}$
13: $[Re(NO)ClCN_4]^{2-}$
14: $[Rh(NO)\ _2Cl_4]^-$
15: $[Rh(NO)\ (H_2O)Cl_4]^-$
16: $[Ru(NO)CN_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^-$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$

One type of these metal ions or complex ions may be employed and the same type of metals or the different type of metals may be employed in combinations of two or more types.

Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation.

The addition may be carried out several times by dividing the added amount. Uniform content in the interior of a silver halide grain can be carried out. As described in Japanese Patent Publication Open to Public Inspection No. 63-29603, 2-306236, 3-167545, 4-76534, 6-110146, 5-273683, etc., incorporation can be carried out so as to result in distribution formation in the interior of a grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

In the present invention, organic silver salts are reducible silver sources and preferred are organic acids and silver salts of hetero-organic acids having a reducible silver ion source, specifically, long chain (having from 10 to 30 carbon atoms, but preferably from 15 to 25 carbon atoms) aliphatic carboxylic acids and nitrogen-containing heterocyclic rings.

Organic or inorganic silver salt complexes are also useful in which the ligand has a total stability constant for silver ion of 4.0 to 10.0.

Examples of preferred silver salts are described in Research Disclosure, Items 17029 and 29963, and include the following; organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-carboxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.)), hydroxy-substituted acids (for example, salicylic acid, benzoic acid, 3,5-dihydroxybenzoic acid, 5,5-thiodisalicylic acid, silver salts or complexes of thioenes (for example, 3-(2-carboxyethyl)-4-hydroxymethyl-4-(thiazoline-2-thioene and 3-carboxymethyl-4-thiazoline-2-thioene)), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides.

In the present invention, of these, the preferred organic silver salts are silver behenate, silver stearate, and silver arachidate. These silver salts may be used in combination.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in Japanese Patent Publication Open to Public Inspection No. 9-127643, etc.

In the present invention, organic silver salts have an average grain diameter of 1 μm and are monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.01 and 0.8 μm, and is most preferably between 0.05 and 0.5 μm. Furthermore, the monodisperse as described herein is the same as silver halide grains and preferred monodispersibility is between 1 and 30 percent. In the present invention, the organic silver salts are preferably composed of monodispersed grains with an average diameter of not more than 1 μm. When grains are prepared within this range, high density images can be obtained. In the invention, a tabular grain having a tabular ratio, which is a quotient obtained by dividing projected area of the organic silver grain by thickness, is 2 to 200, preferably 3 to 100, is preferred. Hereon, the projected area of the organic silver tabular grain is the area of the grain observed from just above when individual grain is photographed in a replica method with a transmission electron microscope, the thickness is calculated from a length of a shadow of replica. There are some methods to measure the area and thickness of the grains, that is, measuring methods by observing with an electron microscope after removing a protective colloid from a formed grain, observing with the electron microscope after removing a binder from a coated sample, or observing with the electron microscope a section of the coated sample, and these methods can be used in combination. In the invention, the thickness of the organic silver tabular grain is preferably 0.005 to 0.2 μm, more preferably 0.005 to 0.15 μm, especially preferably 0.005 to 0.1 μm. The average grain size of the organic silver tabular grain is preferably 0.2 to 1.2 μm, more preferably 0.35 to 1.0 μm. In the invention, as a method for making a tabular ratio within the scope of the invention, there are some methods by controlling pH, temperature, potential, speed etc. when silver nitrate is added to an organic acid soap, by controlling pH, temperature, potential, speed etc. by adding the organic acid soap and silver nitrate simultaneously by using double-jet method, by ripening in a reaction vessel after forming the organic acid silver, by dispersing together with binder by using a dispersing apparatus after forming the organic acid silver. These methods can be used singly or in combination. Of these, it is preferable to use the method by which the organic silver tabular grain within the scope of the invention is formed by dispersing together with binder and surfactant by using a dispersing apparatus after forming the organic silver salt. It is preferable that not less than 50% of total number of the organic silver grains is occupied with the tabular grains having the tabular ratio of not less than 2, more preferably 55 to 100%, still more preferably 60 to 100%.

In the present invention, the total amount of silver halides and organic silver salts is preferably between 0.3 and 2.5 g per $m^2$ in terms of silver amount. When these are prepared within this range, high contrast images can be obtained. Furthermore, the amount of silver halides to that of total silver is not more than 50 percent by weight; is preferably not more than 25 percent, and is more preferably between 0.1 and 15 percent.

A reducing agent is preferably incorporated into the thermally developable photosensitive material to which the present invention is applied. Examples of suitable reducing agents are described in U.S. Pat. Nos. 3,770,448, 3,773,512, and 3,593,863, and Research Disclosure Items 17029 and 29963, and include the following.

Aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfhydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones.

Of these, particularly preferred reducing agents are hindered phenols.

As hindered phenols, listed are compounds represented by the general formula (A) described below.

General formula (A)

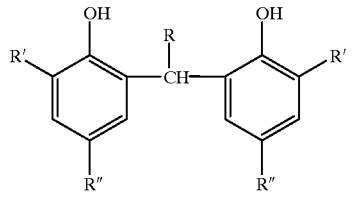

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Specific examples of the compounds represented by the general formula (A) are described below. However, the present invention is not limited to these examples.

A-1

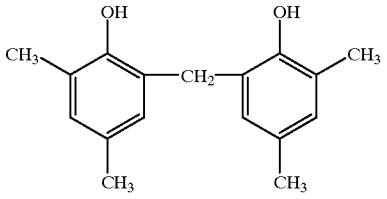

A-2

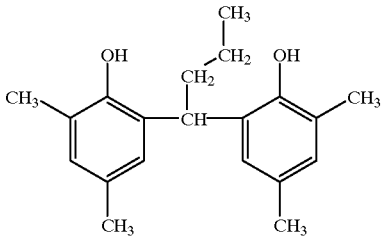

A-3

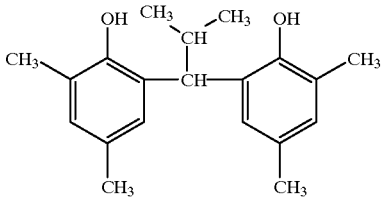

A-4

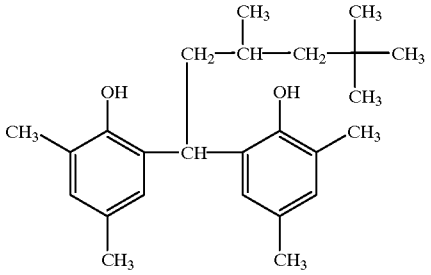

A-5

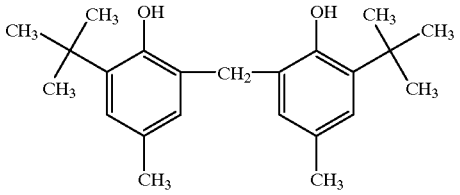

A-6

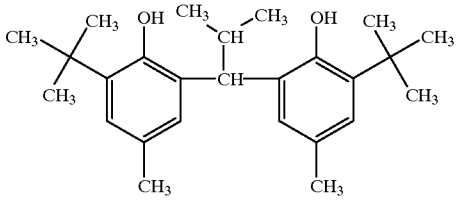

-continued

A-7

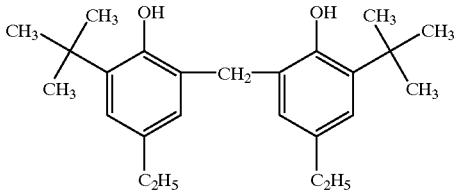

The used amount of reducing agents first represented by the above-mentioned general formula (A) is preferably between $1\times10^{-2}$ and 10 moles per mole of silver, and is most preferably between $1\times10^{-2}$ and 1.5 moles. The thermally developable photosensitive material has one layer or plural layers on a support and said one layer or plural layers contain organic silver salt, photosensitive silver halide grains and reducing agent. Said organic silver salt, photosensitive silver halide grains and reducing agent may be contained in the same layer or each may be contained in different layer. It is preferable that said organic silver salt and photosensitive silver halide grains are contained in the same layer. The reducing agent is preferably contained in the same layer containing the organic silver salt and the photosensitive silver halide grains or in an adjacent layer.

Binders suitable for the thermally developable photosensitive material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly (methylmethacrylic acid), poly(vinyl chloride), poly (methacrylic acid), copoly(styrene-maleic acid anhydride), copoly(styrene-acrylonitrile, copoly(styrene-butadiene, poly (vinyl acetal) series (for example, poly(vinyl formal)and poly(vinyl butyral), poly(ester) series, poly(urethane) series, phenoxy resins, poly(vinylidene chloride), poly(epoxide) series, poly(carbonate) series, poly(vinyl acetate) series, cellulose esters, poly(amide) series. These may be hydrophilic or hydrophobic.

In the present invention, with the purpose of minimizing the size variation after thermal development, the amount of the binder in a photosensitive layer is preferably between 1.5 and 10 $g/m^2$, and is more preferably between 1.7 and 8 $g/m^2$. When the amount is below 1.5 $g/m^2$, the density of an unexposed part markedly increases to occasionally cause no commercial viability.

In the present invention, a matting agent is preferably incorporated into the photosensitive layer side. In order to minimize the image abrasion after thermal development, the matting agent is provided on the surface of a photosensitive material and the matting agent is preferably incorporated in an amount of 0.5 to 10 percent in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc.

Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed.

The size of a matting agent is expressed in the diameter of a sphere which has the same volume as the matting agent. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The variation coefficient of the size distribution as described herein is a value represented by the formula described below.

(Standard deviation of grain diameter)/(average grain diameter)× 100

The matting agent according to the present invention can be incorporated into arbitrary construction layers. In order to accomplish the object of the present invention, the matting agent is preferably incorporated into construction layers other than the photosensitive layer, and is more preferably incorporated into the farthest layer from the support surface. In the invention, to reveal more remarkably the effect of the invention, a smooster value of the outermost surface of the thermally developable photosensitive material according to the invention contacting with the heat element is preferably not more than 50 mmHg, more preferably 0.1 to 40 mmHg, still more preferably 1 to 35 mmHg. The heat element preferably contacts with the surface on the photosensitive layer side.

In this invention, the smooster value of the photographic material is defined as a suction pressure (mmHg) measured for the outermost surface of non-exposed and non-developed, namely, raw stock film under the following condition. A measurement is carried out with a smooster meter such as smooster SM-6B produced by Toa Denki Kogyo Co., Ltd. With this smooster meter utilizing a vacuum type air micrometer, an inflowing amount of air is measured through a measuring head adsorbed on the surface of the film to be measured, and the inflowing amount of air is varied depending on the roughness of the surface and the inflowing amount of air is converted into a pressure (mmHg). High pressure value means that the roughness on the surface is large or that number of rough portions on the surface is many. The measuring head was put on the surface of the film to be measured, and air in the measuring head is evacuated with a vacuum pump through an outlet having a given open area which is attached to the measuring head, then the pressure P (mmHg) in the measuring head is read and indicated as the smooster value. Prior to the measurement, the film is allowed to stand at 23 ° C., 48% R.H., for 2 hours, and measured under the same condition using the above mentioned apparatus. The smooster value of the outermost surface on the opposite side to the surface on the support contacting with the heat element is preferably not less than 70 mmHg, more preferably 80 to 400 mmHg, still more preferably 90 to 250 mmHg, so that an automatic transport by an image setter and an automatic processor is not hindered. As a preferable embodiment of the invention, the smooster value of the outermost surface on the photosensitive layer side of the thermally developable photosensitive material is not more than 50 mmHg and the smooster value of the outermost surface on the opposite side to the photosensitive layer of the thermally developable photosensitive material is not less than 70 mmHg. The smooster value is determined by an amount of binder such as polyvinylbutyral, celluloseacetatebutylate, polyester and polymer latex, particle size, particle shape and adding amount of matting agent, kind and amount of compounds such as hardener and plasticizer capable of changing property of binder, and coating and drying condition. In the invention, combining the above mentioned techniques, an optimum smooster value is attained.

Addition methods of the matting agent according to the present invention include those in which a matting agent is previously dispersed into a coating composition and is then coated, and prior to the completion of drying, a matting agent is sprayed. When a plurality of matting agents is added, both methods may be employed in combination.

A protective layer is preferably coated on more outer layer than the emulsion layer containing photosensitive silver halide grains (opposite side to the support). In this case, matting agent is preferably contained in the protective layer.

In the invention, to reveal more remarkably the effect of the invention, hardness value, measured by a thin layer hardness meter, of the layer of the thermally developable photosensitive material according to the invention contacting with the heat element is preferably not less than 0.8 GPa, more preferably 0.9 to 2.0 GPa, still more preferably 0.95 to 1.6 GPa. In cases where there is a protective layer protecting an emulsion layer, the hardness value of the protective layer is preferably to be the same as mentioned above.

In the invention, the hardness value measured with the thin layer hardness meter is the hardness value measured according to a minute hardness test method of JIS Z 2251, concretely the hardness value indicates the hardness value measured by using the thin layer hardness meter MHA-400 (produced by Nihon Denki Co., Ltd). Two parameters are obtained, one is a pressing load, another one is a pressing speed, obtained by pressing a minute pressed member onto a sample. Since the hardness occasionally changes depending on circumstance humidity, in the invention, the measurement is carried out under the condition of 23° C., 50% R.H. Further, kind of measuring meter is in conformity with JIS B 7734 (minute hardness test machine). With respect to the measurement of the hardness value of the outermost layer, using a sample of the photosensitive material comprising the support, the hardness value is measured when the pressed member is pressed to reach the 50% thickness of the outermost layer in depth by observing with a scanning electron microscope (SEM). In cases where there are two or more protective layers, after peeling off an upper layer by using a microtome, the hardness value of a lower layer was measured, and the hardness value of each protective layer was measured, then among the hardness values of these protective layers, the lowest hardness value is employed. As means to make the hardness value of the protective layer to be within the above mentioned range, there may be some means such as selecting kind of binder, adding solid filler, and selecting optimum coating and drying condition, and these techniques are preferably used in combination.

As binders preferably used in this invention, can be used the binders as mentioned above, and binders having relatively high glass transition temperature (Tg) of not less than 80° C. are suitable, concretely are cited gelatin, polyvinylalcohol and cellulose acetatebutylate. An amount of binder used in the outermost layer such as the protective layer is preferably 0.1 to 5 g/m$^2$, more preferably 0.2 to 4 g/m$^2$. In cases where there are plural protective layers, total amount of binder used in the plural layers is in the above mentioned range.

As solid fillers, are cited colloidal silica described in Japanese Patent Publication Open to Public Inspection Nos. 55-126239, 4-214551, phosphates such as colloidal montmorillonite clay or hydroxyapatite described in Japanese Patent Publication Open to Public Inspection No. 60-202438, tabular silica such as smectites, inorganic substance such as zeolite, and polymer particles having glass transition temperature of not less than 40° C. The surface of these fillers is preferably treated for the purpose of dispersion stabilization. As concrete examples, is preferably used coat of silane coupling agent or coat of titanium coupling agent described in Japanese Patent Publication Open to Public Inspection No. 4-257849. An average particle diameter of the above mentioned colloidal silica is 0.005 to 1.0 $\mu$m, preferably 0.005 to 0.5 $\mu$m, and major component of the colloidal silica is silicon dioxide and may contain alumina or sodium aluminate as minor component. The colloidal silica may contain, as stabilizers, inorganic bases such as sodium hydroxide, potassium hydroxide, lithium hydroxide, and ammonia etc. As concrete examples of the colloidal silica, Snowtex 30, Snowtex C, Snowtex O or Rudox AM produced by Nissan Kagaku Co., Ltd. are commercially available.

The tabular silica is a layer-like silicate containing alkaline and alkaline earth metal, and ammonium etc., for example, are cited kaolin minerals such as kaolinite, dickite, nacrite, halloysite, and serpentine etc.; mica clay minerals such as pyrophyllite, talc. commonmica, swelling synthetic fluorine-containing mica, sericite, and chlorite etc.; smectites such as smectites, vermiculite, swelling synthetic fluorine-containing vermiculite etc. Synthetic substances are preferably used because of an excellent transparency, for example, are cited Rucentite SWN, SWF produced by Corp Chemical Co., Ltd. In the case of using the tabular silica, it is preferred to use the tabular silica having an aspect ratio (ratio of a diameter of a circle having the same area as the projected area to a distance of two parallel planes) of not less than 2 in 50% or more of total projected area of used silica. A thickness is preferably not more than 1.0 $\mu$m, more preferably 0.5 $\mu$m.

The phosphate is an inorganic compound composed of phosphoric acid and a complex of phosphoric acid and an organic compound, concretely are cited apatite, nacicon, ammonium phosphate, magnesium phosphate and silver phosphate etc. Of these, the apatite is preferred. As the apatite, are cited hydroxyapatite $Ca_{10}(PO_4)_6(OH)_2$, fluorineapatite $Ca_{10}(PO_4)_6(F)_2$, and chlorineapatite $Ca_{10}(PO_4)_6(Cl)_2$. They may form minuteness, porousness and their complex system, and may be in any form of sphere, amorphousness, needle and thin leaf.

The zeolite is aluminium silicate and has a basic chemical structure, $XM_2/nO.Al_2O_3.YSiO_2.ZH_2O$, based on $Al_2O_3$. There are natural and synthetic zeolites, and any of them is usable, but synthetic one is preferred because it has fewer impurity. As natural zeolites, are cited analcite, erionite, mordenite, shavanite, gmelinite and levynite etc. As synthetic zeolites, are cited zeolite A, zeolite X, zeolite Y, zeolite L and synthetic mordenite etc., and they may be in any form of sphere, amorphousness, needle and thin leaf. As commercially available zeolites, are cited 3 A, 4 A, 5 A, AW-500, 10 X, and 13 X produced by Toso Co., Ltd., molecular sieve LINDER ZB-300, and Silicalite produced by Union Carbide Co., Ltd., ZSM-5 produced by Mobil Co., Ltd.

Since the fillers are added in the protective layer, smaller particle size of them is preferred, and preferably not more than 1 $\mu$m, more preferably not more than 0.1 $\mu$m. Adding amount of them is preferably not less than 0.1 g/m$^2$, more preferably 0.2 to 1.0 g/m$^2$.

The thermally developable photosensitive material, to which the present invention is applied, is subjected to formation of photographic images employing thermal development processing and preferably comprises a reducible silver source (organic silver salt), silver halide with an catalytically active amount, a hydrazine derivative, a reducing agent and, if desired, an image color control agent, to adjust silver tone, which are generally dispersed into a (organic) binder matrix.

The thermally developable photosensitive material, to which the present invention is applied, is stable at normal temperatures and is developed, after exposure, when heated to not less than 250° C. Upon heating, silver is formed through an oxidation-reduction reaction between the organic silver salt (functioning as an oxidizing agent) and the reducing agent. This oxidation-reduction reaction is accelerated by the catalytic action of a latent image formed in the silver halide through exposure. Silver formed by the reaction with the organic silver salt in an exposed area yields a black image, which contrasts with an unexposed area to form an image. This reaction process proceeds without the further supply of a processing solution such as water, etc. from outside.

The thermally developable photosensitive material, to which the present invention is applied, comprises a support having thereon at least one photosensitive layer, and the photosensitive layer may only be formed on the support. Further, at least one nonphotosensitive layer is preferably formed on the photosensitive layer. In order to control the amount or wavelength distribution of light transmitted through the photosensitive layer, a filter layer may be provided on the same side as the photosensitive layer, or on the opposite side. Dyes or pigments may also be incorporated into the photosensitive layer. As the dyes, preferred are compounds described in Japanese Patent Application No. 7-11184. The photosensitive layer may be composed of a plurality of layers. Furthermore, for gradation adjustment, in terms of sensitivity, layers may be constituted in such a manner as a fast layer/slow layer or a slow layer/fast layer. Various types of additives may be incorporated into any of a photosensitive layer, a nonphotosensitive layer, or other formed layers.

Surface active agents, antioxidants, stabilizers, plasticizers, UV absorbers, covering aids, etc. may be employed in the thermally developable photosensitive material to which the present invention is applied.

Image color control agents are preferably incorporated into the thermally developable photosensitive material to which the present invention is applied. Examples of suitable image color control agents are disclosed in Research Disclosure Item 17029, and include the following;

imides (for example, phthalimide), cyclic imides, pyrazoline-5-ones, and quinazolinon (for example, succinimide, 3-phenyl-2-pyrazoline-5-one, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis (isothiuroniumtrifluoroacetate), and 2-(tribromomethylsulfonyl)benzothiazole; merocyanine dyes (for example, 3-ethyl-5-((3-etyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone+benzenesulfinic acid sodium or 8-methylphthalazinone+p-trisulfonic acid sodium); combinations of phthalazine+phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, nartoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

Antifoggants may be incorporated into the thermally developable photosensitive material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and Japanese Patent Publication Open to Public Inspection No. 59-57234.

Particularly preferred mercury-free antifoggants are heterocyclic compounds having at least one substituent, represented by —C(X1)(X2)(X3) (wherein X1 and X2 each represents halogen, and X3 represents hydrogen or halogen), as disclosed in U.S. Pat. Nos. 3,874,946 and 4,756,999. As examples of suitable antifoggants, employed preferably are compounds and the like described in paragraph numbers [0062] and [0063] of Japanese Patent Publication Open to Public Inspection No. 9-90550.

Furthermore, more suitable antifoggants are disclosed in U.S. Pat. No. 5,028,523, and U.K. Patent Application Nos. 9221383. No. 4, 9300147. No. 7, and 9311790. No. 1.

In the thermally developable photosensitive material to which the present invention is applied, employed can be sensitizing dyes described, for example, in Japanese Patent Publication Open to Public Inspection Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, November 1978), 1831, Section X (page 437, August 1978). Particularly, selected can advantageously be sensitizing dyes having the spectral sensitivity suitable for spectral characteristics of light sources of various types of scanners. For example, compounds are preferably employed which are described in Japanese Patent Publication Open to Public Inspection Nos. 9-34078, 9-54409, and 9-80679. Among them, infrared spectral sensitizing dyes having spectral sensitization in the infrared region of 700 to 900 nm are preferably used. As the examples of these dyes, the dyes described in U.S. Pat. No. 5,393,645, Japanese Patent Publication to Public Inspection under PCT Application No. 9-510022 and International Publication No. 96-33442 are preferably used.

Supports employed in the present invention are preferably, in order to obtain predetermined optical density after development processing and to minimize the deformation of images after development processing, plastic films (for example, polyethylene terephthalate, polycarbonate, polyimide, nylon, cellulose triacetate, polyethylene naphthalate).

Of these, as preferred supports, listed are polyethylene terephthalate (hereinafter referred to as PET) and other plastics (hereinafter referred to as SPS) comprising styrene series polymers having a syndiotactic structure. The thickness of the support is between about 50 and about 300 $\mu$m, and is preferably between 70 and 180 $\mu$m.

Furthermore, thermally processed plastic supports may be employed. As acceptable plastics, those described above are listed. The thermal processing of the support, as described herein, is that after film casting and prior to the photosensitive layer coating, these supports are heated to a temperature at least 30° C. higher than the glass transition point by not less than 30° C. and more preferably by at least 40° C. However, when the supports are heated at a temperature higher than the melting point, no advantages of the present invention are obtained.

Plastics employed in the present invention are described below.

PET is a plastic in which all the polyester components are composed of polyethylene terephthalate. However, other than polyethylene terephthalate, employed also may be polyesters in which modified polyester components such as acid components, terephthalic acid, naphthalene-2,6-dicaroxylic acid, isophthalic acid, butylenecarboxylic acid, 5-sodiumsulfoisophthalic acid, adipic acid, etc., and as glycol components, ethylene glycol, propylene glycol, butanediol, cyclohexane dimethanol, etc. may be contained in an amount of no more than 10 mole percent, with respect to the total polyester content.

SPS is different from normal polystyrene (atactic polystyrene) and a polystyrene having stereoregularity. The stereoregular structure portion of SPS is termed a racemo chain and the more regular parts increase as 2 chains, 3 chains, 5 chains or more chains, the higher being, the more preferred. In the present invention, the racemo chains are preferably not less than 85 percent for two chains, not less than 75 percent for three chains, not less than 50 percent for five chains, and 30 percent for not less than 5 chains. SPS can be polymerized in accordance with a method described in Japanese Patent Publication Open to Public Inspection No. 3-131843.

As the base casting method of the support and subbing production method which are associated with the present invention, any of those known in the art can be employed.

However, those methods described in paragraphs [0030] through [0070] of Japanese Patent Publication Open to Public Inspection No. 9-50094 are preferably employed.

EXAMPLES

The present invention is explained with reference to examples below. However, the present invention is not limited to these examples.

Example 1

(Preparation of a Photographic Subbed Support)

<Preparation of a Photographic Subbed PET Support>

Commercially available biaxially stretched thermally fixed 100 μm PET film was subjected to corona discharging treatment of 8 w/m$^2$·minute on both sides. Onto the surface of one side, the subbing coating composition a-1 described below was applied and dried so as to form a dry thickness of 0.8 μm and the resulting coating was designated Subbing Layer A-1. Furthermore, onto the opposite side surface, the antistatic treatment subbing coating composition b-1 described below was applied, so as to form a dry thickness of 0.8 μm, and the resulting coating was designated Antistatic Treatment Subbing Layer B-1.

| <Subbing Coating Composition a-1> | |
|---|---|
| Latex composition (solid portion of 30 percent of a copolymer composed of butyl acrylate (20 weight percent), t-butyl acrylate (20 weight percent), styrene (25 weight percent), and 2-hydroxyethyl acrylate (25 weight percent) | 270 g |
| (C-1) | 0.6 g |
| Hexamethylene-1,6-bis(ethyleneurea) | 0.8 g |
| Water to make | 1 liter |
| **<Subbing Coating Composition b-1>** | |
| Latex composition (solid portion of 30 percent of a copolymer composed of butyl acrylate (40 weight percent), styrene (20 weight percent), and glycidyl acrylate (40 weight percent) | 270 g |
| (C-1) | 0.6 g |
| Hexamethylene-1,6-bis(ethyleneurea) | 0.8 g |
| Water to make | 1 liter |

Subsequently, the surfaces of subbing layers A-1 and B-1 were subjected to corona discharging of 8 w/m$^2$·minute, and onto the subbing layer A-1, the subbing upper layer coating composition a-2 described below was coated to form subbing layer A-2 so as to obtain a dried thickness of 0.1 μm, and onto the subbing layer B-1, the subbing upper layer coating composition b-2 described below was coated to form subbing upper layer B-2 exhibiting antistatic function so as to obtain a dried thickness of 0.8 μm.

| <Subbing Upper Layer Coating Composition a-2> | |
|---|---|
| Gelatin | weight to make 0.4 g/m$^2$ |
| (C-1) | 0.2 g |
| (C-2) | 0.2 g |
| (C-3) | 0.1 g |
| Silica particles (average diameter of 3 μm) | 0.1 g |
| Water to make | 1 liter |

-continued

| <Subbing Upper Layer Coating Composition b-2> | |
|---|---|
| (C-4) | 60 g |
| Latex composition comprising (C-5) as a component (solid portion) of 20 percent | 80 g |
| Ammonium sulfate | 0.5 g |
| (C-6) | 12 g |
| Polyethylene glycol(weight average molecular weight of 600) | 6 g |
| Water to make | 1 liter |

(C-1)

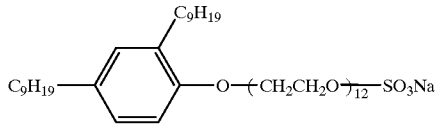

(C-2)

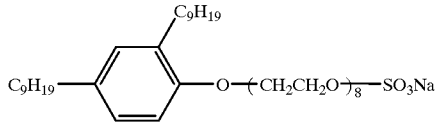

(C-3)

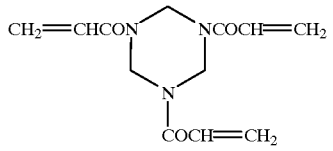

(C-4)

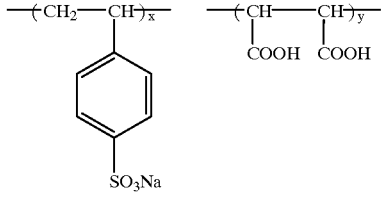

$\overline{M}_n$ = 5000

($\overline{M}n$ is number average molecular weight)

x:y = 75:25 (weight ratio)

(C-5)

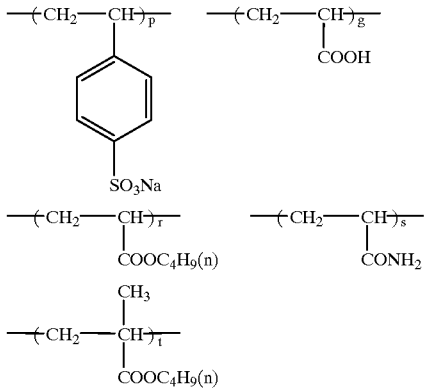

p:q:r:s:t = 40:5:10:5:40 (Weight ratio)

-continued (C-6)

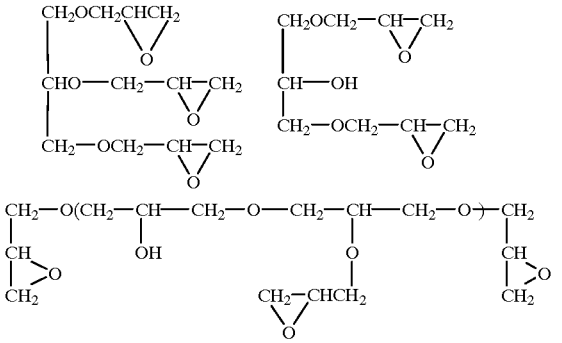

Mixture of three compounds above (Thermal Treatment of Support)

During subbing drying process for the above-mentioned subbed support, the support was heated at 140° C. and was then cooled gradually.

(Preparation of Emulsion A)

In 900 ml of water, 7.5 g of inert gelatin and 10 mg of potassium bromide were dissolved. After adjusting the temperature to 35° C. and the pH to 3.0, 370 ml of an aqueous solution containing 74 g of silver nitrate, an aqueous solution containing potassium bromide and potassium iodide in a mole ratio of 98/2, $1\times10^{-6}$ mole of $Ir(NO)Cl_6$ salt per mole of silver, and $1\times10^{-4}$ mole of rhodium chloride salt per mole of silver were added employing a controlled double-jet method while maintaining the pAg at 7.7. Subsequently, 4-hydroxy-6-methyl-1,3,3a,7-tetraazaindene was added and the pH was adjusted to 5 using NaOH. Thus, obtained was cubic silver iodobromide grains having an average grain size of 0.06 μm, a projection diameter area variation coefficient of 8 percent, and a [100] plane ratio of 87 percent. The resulting emulsion was subjected to desalting through coagulation precipitation employing a coagulant. After that, 0.1 g of phenoxyethanol was added, and the pH and pAg were adjusted to 5.9 and 7.5, respectively to obtain a silver halide emulsion. Further, the resulting emulsion underwent chemical ripening in the presence of chloroauric acid and inorganic sulfur.

(Preparation of Sodium Behenate Solution)

To 340 ml of isopropanol, 34 g of behenic acid was dissolved at 65° C. Thereafter, with stirring, an aqueous 0.25N sodium hydroxide solution was added so that the pH was adjusted to 8.7. At the time, about 400 ml of an aqueous sodium hydroxide solution was employed. Thereafter, the resulting sodium behenate solution was concentrated under reduced pressure so that the concentration of sodium behenate became 8.9 percent by weight.

(Preparation of Silver Behenate B)

To a solution prepared by dissolving 30 g of ossein gelatin in 750 ml distilled water, a 2.94M silver nitrate solution was added to result in a silver electrical potential of 400 mV. To the resulting solution, 374 ml of the above-mentioned sodium behenate solution was added at 78° C. employing a controlled double-jet method along with an aqueous 2.94M silver nitrate solution at the same time. During the addition, the added amounts of sodium behenate and silver nitrate were 0.092 mole and 0.101 mole, respectively. After the addition, stirring continued for more 30 minutes and water-soluble salts were removed using ultrafiltration. The resulting silver behenate was composed of needle grains having an average grain size of 0.8 μm and a monodispersibility of 8 percent.

(Preparation of Photosensitive Emulsion)

To 0.1 mole of the resulting silver behenate B, 0.01 mole of the above-mentioned silver halide emulsion A was added. With continuous stirring, dispersion flocks were formed by gradually adding 100 g of a butyl acetate solution containing vinyl acetate (1.2 percent by weight). Subsequently, water was removed and further, water washing and water removal were carried out two more times. Then, with stirring, added was 60 g of a mixture consisting of butyl acetate containing 2.5 weight percent polyvinyl butyral (average molecular weight of 3,000) as a binder and isopropyl alcohol in a ratio of 1:2. Thereafter, a gel-like mixture consisting of behenic acid and silver halide, as prepared above, was added with polyvinyl butyral (average molecular weight of 4,000) as a binder and isopropyl alcohol, and was dispersed. After dispersion, the organic silver grains were the tabular grains having average grain size of 0.5 μm and maximum tabular ratio of 20 and the content ratio of the organic silver tabular grains having tabular ratio of not less than 2 in total organic silver grains was 90%.

Onto the supports shown in Table 1, each layer described below was subsequently applied to prepare samples. Further each sample was dried at 75° C. for 5 minutes.

Coating onto Back Side Surface: the composition described below was coated to form a wet thickness of 80 μm.

| | |
|---|---|
| Polyvinyl butyral (10 percent isopropanol solution) | 150 ml |
| Dye-B | 70 mg |
| Dye-C | 70 mg |

Dye-B

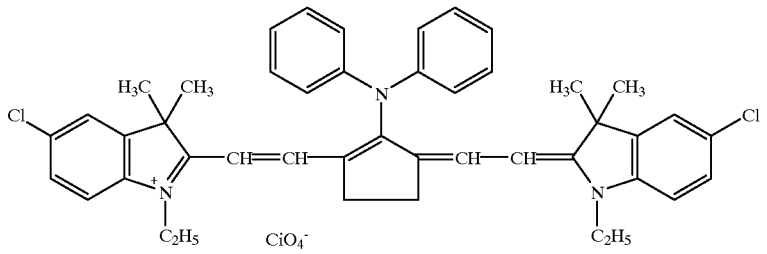

-continued

Dye-C

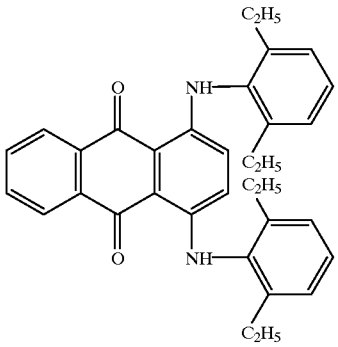

Coating onto Surface of Photosensitive Layer Side

Photosensitive layer: the composition described below was coated so that the coated silver amount was 1.3 g/m$^2$ and polyvinyl butyral as a binder was 3.5 g/m$^2$.

| Photosenstive emulsion | as silver, amount to make 1.3 g/m$^2$ |
|---|---|
| Sensitizing dye-1 (0.1% DMF solution) | 2 mg |
| Antifoggant-1 (0.01% methanol solution) | 3 ml |
| Antifoggant-2 (1.5% methanol solution) | 8 ml |
| Antifoggant-3 (2.4% DMF solution) 5 ml | |
| Phthalazone (4.5% DMF solution) 8 ml | |
| Developing agent-1 (10% acetone solution) | 20 ml |

Sensitizing dye-1

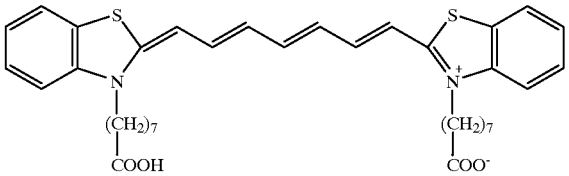

Antifoggant-1

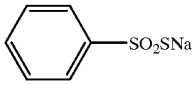

Antifoggant-2

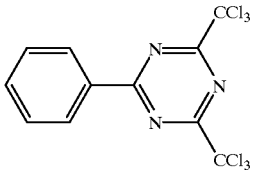

Antifoggant-3

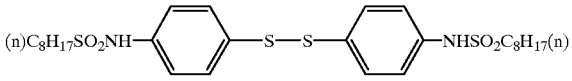

-continued

Developing agent-1

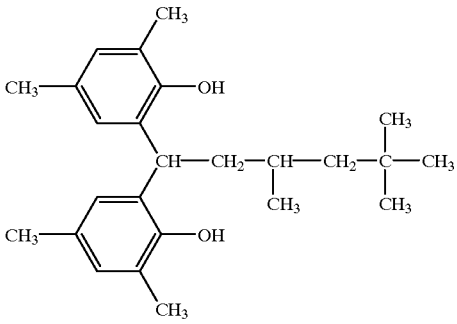

Surface protective layer: the composition described below was coated onto the photosensitive layer so as to obtain a wet thickness of 100 $\mu$m.

| | |
|---|---|
| Acetone | 175 ml |
| 2-Propanol | 40 ml |
| Methanol | 15 ml |
| Cellulose acetate | 8.0 g |
| Phthalazine | 1.0 g |
| 4-Methylphthalic acid | 0.72 g |
| Tetrachlorophthalic acid | 0.22 g |
| Tetrachlorophthalic acid anhydride | 0.5 g |
| Matting agent: polymethyly methacrylate with an average grain size of 4 $\mu$m | 2.0 g |

After a thermally developable photosensitive sample as prepared above was allowed to stand at 23° C., 48% R.H. for 2 days, smooster value of the surface was measured by using a smooster meter, SM-6B produced by Toei Denki Kogyo Co., Ltd. The smooster value of the surface of the uppermost layer on the emulsion layer side was 20 mmHg and that of the surface of the uppermost layer on the backing layer side was 120 mmHg. And after the thermally developable photosensitive sample was allowed to stand at 23° C., 50% R.H. for 2 days, hardness value of the protective layer was measured by using a thin layer hardness meter produced by Nihon Denki Co., Ltd. The obtained hardness value of the protective layer was 1.1 GPa.

<Measurement of Size Repetition Accuracy>

A thermally developable photosensitive sample as prepared above was subjected to image exposure of two fine lines with an interval of 500 mm using an image setter having a 760 nm semiconductor laser.

Thereafter, development was carried out employing a device with arranged 1,000 thermal heads having the heating element according to the present invention so as to achieve thermal development temperature and time shown in Table 1.

As comparison, thermal development was carried out at 120° C. for 15 seconds employing a heating drum.

At the time, exposure and development were carried out in a room conditioned at 23° C. and RH 50%. This operation was repeated four times and the distance between two fine lines was accurately measured. In that case, R represents the difference between the maximum and the minimum and the size repetition accuracy T was obtained in accordance with the formula described below. If the repetition accuracy is not within 0.1 percent, application to color printing is not viable.

$T=(R/W)\times 100$ (%)

W: length of a sample prior to development

Table 1 shows the evaluation results.

<Evaluation on Staining after Thermal Development>

The thermally developable photosensitive material prepared as above was divided into two parts; one part was incubated in a thermostat at 50° C. and 50% for 5 days, and staining of the unexposed part of the resulting sample was visually evaluated.

No staining was evaluated to be Rank 5. As staining increases, Rank decreases as 4, 3, 2, and 1. Rank 1 indicates the formation of dense brown staining. Those which do not reach Rank 3 are not commercially viable.

<Evaluation on Silver Tone after Thermal Development>

Silver tone of the exposed part of the sample as incubated above was visually evaluated and ranked as described below.

Those exhibiting blue black tone were evaluated to be Rank 5, and as the tone became more warm black, Rank decreased as 4, 3, 2, and 1. Rank 1 indicates those colored in brown. Those which do not reach Rank 3 are not commercially viable.

Table 1 shows the evaluation results.

TABLE 1

| Sample No. | Heating Device for Thermal Development | Thermal Development Temperature and Time | Size Repetition Accuracy (%) | Performance after Incubation at 50° C. for 5 Days: Staining | Performance after Incubation at 50° C. for 5 Days: Silver Tone | |
|---|---|---|---|---|---|---|
| 1 | Heat Roller | 120° C., 15 sec | 0.5 | 2 | 1 | Comp. |
| 2 | Thermal Head | 290° C., 5 msec | 0.09 | 4 | 4 | Inv. |
| 3 | Thermal Head | 400° C., 3 msec | 0.06 | 5 | 4 | Inv. |

Comp.; Comparative, Inv.; Present Invention

Example 2

Samples were prepared in the same manner as for Example 1, except that to the photosensitive layer, a 1 percent solution prepared by dissolving $1\times10^{-3}$ mole of a hydrazine derivative in a solution of methanol/DMF in a ratio of 4:1 was added. The resulting samples were evaluated in the same manner as in Example 1 and as described below. The smooster value of the surface and the hardness value of the protective layer were the same as those obtained in example 1.

<Quality Evaluation on Small Dot of Halftone Dot>

The thermally developable photosensitive material as prepared above was subjected to exposure employing an image setter having a 760 nm semiconductor laser so that the halftone dot is varied by 5 percent from 0 percent to 100 percent. Thereafter, the resulting sample was subjected to thermal development processing shown in Table 2.

After development, the halftone dot quality of the part subjected to 5 percent exposure was evaluated employing a loupe with 40 times magnification. Those which exhibited the highest quality without roughness were evaluated to be Rank 5 and as the quality degrades, Rank decreased as 4, 3, 2, and 1.

Table 2 shows the evaluation results.

TABLE 2

| Sample No. | Thermal Device for Thermal Development | Thermal Development Temperature and Time | Hydrazine Derivative | Size Repetition Accuracy (%) | Small Dot Quality of Halftone Dot | Performance after Incubation at 50° C. for 5 Days: Staining | Performance after Incubation at 50° C. for 5 Days: Silver Tone | |
|---|---|---|---|---|---|---|---|---|
| 1 | Heat Roller | 120° C., 15 sec | H-27 | 0.5 | 1 | 2 | 2 | Comp. |
| 2 | Thermal Head | 300° C., 6 msec | H-27 | 0.08 | 4 | 4 | 4 | Inv. |
| 3 | Thermal Head | 320° C., 5 msec | H-20 | 0.07 | 5 | 4 | 4 | Inv. |
| 4 | Thermal Head | 400° C., 3 msec | H-32 | 0.06 | 5 | 5 | 4 | Inv. |

Comp.; Comparative, Inv.; Present Invention

Example 3

Samples were prepared in the same manner as for Example 2, except that hydrazine derivatives in the photosensitive layer of Example 2 were replaced with the quaternary onium compounds shown in Table 3. The resulting samples were evaluated in the same manner as Example 2. The smooster value of the surface and the hardness value of the protective layer were the same as those obtained in example 1.

Table 3 shows the results.

TABLE 3

| Sample No. | Thermal Device for Thermal Development | Thermal Development Temperature and Time | Quaternary onium compound | Size Repetition Accuracy (%) | Small Dot Quality of Halftone Dot | Performance after Incubation at 50° C. for 5 Days Staining | Silver Tone | |
|---|---|---|---|---|---|---|---|---|
| 1 | Heat Roller | 120° C., 15 sec | F-16 | 0.5 | 1 | 2 | 2 | Comp. |
| 2 | Thermal Head | 300° C., 6 msec | P-16 | 0.09 | 4 | 4 | 4 | Inv. |
| 3 | Thermal Head | 350° C., 5 msec | P-10 | 0.08 | 4 | 4 | 4 | Inv. |
| 4 | Thermal Head | 380° C., 3 msec | T-7 | 0.07 | 4 | 4 | 5 | Inv. |

Comp.; Comparative, Inv.; Present Invention

Disclosed embodiment can be varied by a skilled person without departing from the spirit and scope of the invention.

What is claimed is:

1. A processing method for developing a thermally developable photosensitive material which is imagewise exposed to 600 to 800 nm semiconductor light, said method comprising thermally developing said thermally developable photosensitive material by a heating element which intermittently heats at a surface temperature from 250° C. to 500° C. and a duration time between 0.01 and 10 milliseconds, wherein said thermally developable photosensitive material comprising a support having thereon at least one layer containing an organic silver salt, photosensitive silver halide grains and a reducing agent.

2. A processing method of claim 1, wherein one layer or plural layers of said thermally developable photosensitive material contain a hydrazine derivative.

3. A processing method of claim 1, wherein one layer or plural layers of said thermally developable photosensitive material contain a quaternary onium compound.

4. A processing method of claim 1, wherein said thermally developable photosensitive material comprising a support having thereon plural layers, wherein plural layers comprises an emulsion layer containing said photosensitive silver halide grains and a protective layer protecting said emulsion layer.

5. A processing method of claim 1, wherein said thermally developable photosensitive material is thermally developed by contacting said thermally developable photosensitive material with said heating element.

6. A processing method of claim 5, wherein said thermally developable photosensitive material is thermally developed by contacting a side of the layer containing said photosensitive silver halide grains of said thermally developable photosensitive material with said heating element.

7. A processing method of claim 5, wherein smooster value of the surface of said thermally developable photosensitive material contacting with said heating element is not more than 50 mmHg.

8. A processing method of claim 5, wherein hardness of the surface of said thermally developable photosensitive material contacting with said heating element is not less than 0.8 Gpa.

9. The processing method claim 1, wherein the thermally developable photosensitive material is imagewise exposed to 760 nm semiconductor laser light.

10. A processing method for developing a thermally developable photosensitive material which is imagewise exposed, said method comprising thermally developing said thermally developable photosensitive material by a thermal head which intermittently heats at surface temperature 250° C. to 500° C. and a duration time between 0.01 and 10 milliseconds, wherein said thermally developable photosensitive material comprising a support having thereon one layer containing an organic silver salt, photosensitive silver halide grains and a reducing agent.

* * * * *